US007399169B2

(12) United States Patent
Nakamura

(10) Patent No.: US 7,399,169 B2
(45) Date of Patent: Jul. 15, 2008

(54) COMPRESSOR

(75) Inventor: Shinji Nakamura, Isesaki (JP)

(73) Assignee: Sanden Corporation, Gunma (JP)

( * ) Notice: Subject to any disclaimer, the term of this patent is extended or adjusted under 35 U.S.C. 154(b) by 353 days.

(21) Appl. No.: 10/513,765

(22) PCT Filed: Apr. 25, 2003

(86) PCT No.: PCT/JP03/05346

§ 371 (c)(1),
(2), (4) Date: Nov. 9, 2004

(87) PCT Pub. No.: WO03/095835

PCT Pub. Date: Nov. 20, 2003

(65) Prior Publication Data

US 2005/0226749 A1 Oct. 13, 2005

(30) Foreign Application Priority Data

May 10, 2002 (JP) ..... 2002-136060

(51) Int. Cl.
*F04B 1/12* (2006.01)
*F04B 27/08* (2006.01)

(52) U.S. Cl. ..... 417/441; 417/269; 417/559; 251/902; 138/45

(58) Field of Classification Search ..... 417/441, 417/269, 559, 540; 261/902; 138/46, 45
See application file for complete search history.

(56) References Cited

U.S. PATENT DOCUMENTS 2,125,435 A * 8/1938 Erling ..... 251/902
3,703,913 A * 11/1972 Carsten ..... 251/902
3,884,447 A * 5/1975 Alexander et al. ..... 251/902
3,896,834 A * 7/1975 Paul, Jr. ..... 251/902
4,400,142 A * 8/1983 Ohlson, Jr. ..... 417/372
6,257,848 B1 * 7/2001 Terauchi ..... 417/441
2001/0026762 A1 10/2001 Fujita et al.

FOREIGN PATENT DOCUMENTS

JP 59054788 3/1984
JP 01158856 11/1989
JP 07054658 2/1995

OTHER PUBLICATIONS

International Serarch Report mailed Jul. 29, 2003.

* cited by examiner

*Primary Examiner*—Ted Kim
(74) *Attorney, Agent, or Firm*—Baker Botts L.L.P.

(57) ABSTRACT

The invention provides a compressor that can reduce occurrence of vibration and noise due to self-induced vibration of an suction valve at the time of a low flow rate surely with an inexpensive structure. In the compressor according to the invention, an opening regulating valve 40 provided in a refrigerant suction channel 13*c* to a cylinder 11*a* is formed by an elastically deformable spiral member 41, and intervals of spiral portions 41*a* of the spiral member 41 are changed according to a flow rate of a refrigerant, whereby an opening of the channel 13*c* is regulated. Thus, it is possible to reduce occurrence of vibration and noise due to self-induced vibration of an suction valve 14*c* at the time of a low flow rate surely, and it is possible to simplify a structure of the opening regulating valve 40.

1 Claim, 5 Drawing Sheets

COMPRESSOR

This application is the National Stage of International Patent Application No. PCT/JP03/05346, filed Apr. 25, 2003, which claims the benefit of Japanese Patent Application No. 2002/136060, filed Jun. 20, 2002.

TECHNICAL FIELD

The present invention relates to a compressor that is used in, for example, a refrigeration circuit of an air conditioner for vehicles.

BACKGROUND ART

In general, as a compressor of this type, for example, as described in Japanese Patent Publication 2001-289177, there is known a compressor that includes a cylinder having a refrigerant inlet and a refrigerant outlet at one end, a piston reciprocating in the cylinder, and a tabular suction valve and a tabular discharge valve provided in the refrigerant inlet and the refrigerant outlet, such that the refrigerant inlet and the refrigerant outlet are opened and closed by elastic deformation of the suction valve and the discharge valve, respectively.

Incidentally, in the compressor, there is provided a stopper that locks the one end side (free end side) of the suction valve in a predetermined opening position such that the suction valve opens and closes within a predetermined range. However, when a flow rate is low, the suction valve may open and close in a range in which the suction valve does not come into abutment against the stopper. In such a case, there is a problem in that pulsation occurs in the suction refrigerant due to self-induced vibration of the suction valve, which causes vibration and noise in an evaporator and the like that are set in an external circuit on the refrigerant suction side.

Thus, in the compressor, an opening regulating valve, which regulates an opening of a channel according to a flow rate of a refrigerant, is provided in a refrigerant suction side channel of a cylinder head to reduce the opening of the opening regulating valve when a flow rate is low, whereby pulsation of the suction refrigerant propagating to the evaporator side is attenuated to reduce the vibration and noise of the evaporator and the like.

However, the opening regulating valve has a complicated structure in which a valve body is housed in an exclusive valve case and biased in a predetermined direction by a spring attached in the valve case. Thus, there is a problem in that manufacturing cost increases.

The present invention has been devised in view of the problems, and it is an object of the invention to provide a compressor that can reduce occurrence of vibration and noise due to self-induced vibration of an suction valve at the time of a low flow rate surely with an inexpensive structure.

DISCLOSURE OF THE INVENTION

The present invention provides a compressor that includes a cylinder having a refrigerant inlet and a refrigerant outlet at one end, a cylinder head having a refrigerant suction chamber communicating with a refrigerant inlet and a refrigerant discharge chamber communicating with a refrigerant outlet, a piston reciprocating in the cylinder, and an suction valve provided in the refrigerant inlet, and a discharge valve provided in the refrigerant outlet, the refrigerant inlet and the refrigerant outlet being opened and closed by deformation of the suction valve and the discharge valve, respectively, characterized by including an opening regulating valve that is provided in a refrigerant channel communicating with the refrigerant suction chamber or the refrigerant discharge chamber, consists of an elastically deformable spiral member fixed in the channel at one end thereof, and regulates an opening of the channel by changing intervals among spiral portions of the spiral member according to a flow rate of the refrigerant.

Consequently, the intervals among the spiral portions of the opening regulating valve are widened when a flow rate is high, and the opening of the refrigerant channel increases. In addition, when a flow rate is low, since the intervals among the spiral portions of the opening regulating valve are narrowed and the opening of the refrigerant channel decreases, even in the case in which pulsation occurs in the refrigerant due to self-induced vibration of the suction valve or the discharge valve at the time of a low flow rate, the pulsation of the refrigerant propagating to an external circuit on the refrigerant channel side is attenuated by the opening regulating valve.

In addition, in the above-described structure, the invention forms the spiral member of the opening regulating valve such that diameters of the spiral portions gradually decrease from one side toward the other side thereof.

Consequently, since the spiral member is formed such that the diameters of the spiral portions of the opening regulating valve gradually decrease from the one side toward the other side, the spiral member assumes a conical shape that is susceptible to a flow resistance of the refrigerant.

Further, in the above-described structure, the invention provides a blocking member, which blocks a part of the spiral member, in the opening-regulating valve.

Consequently, in addition to the actions of claims 1 and 2, since the refrigerant does not pass the part where the blocking member is provided, a flow rate of the refrigerant is regulated so much more for that.

BEST MODE FOR CARRYING OUT THE INVENTION

Figure 1:
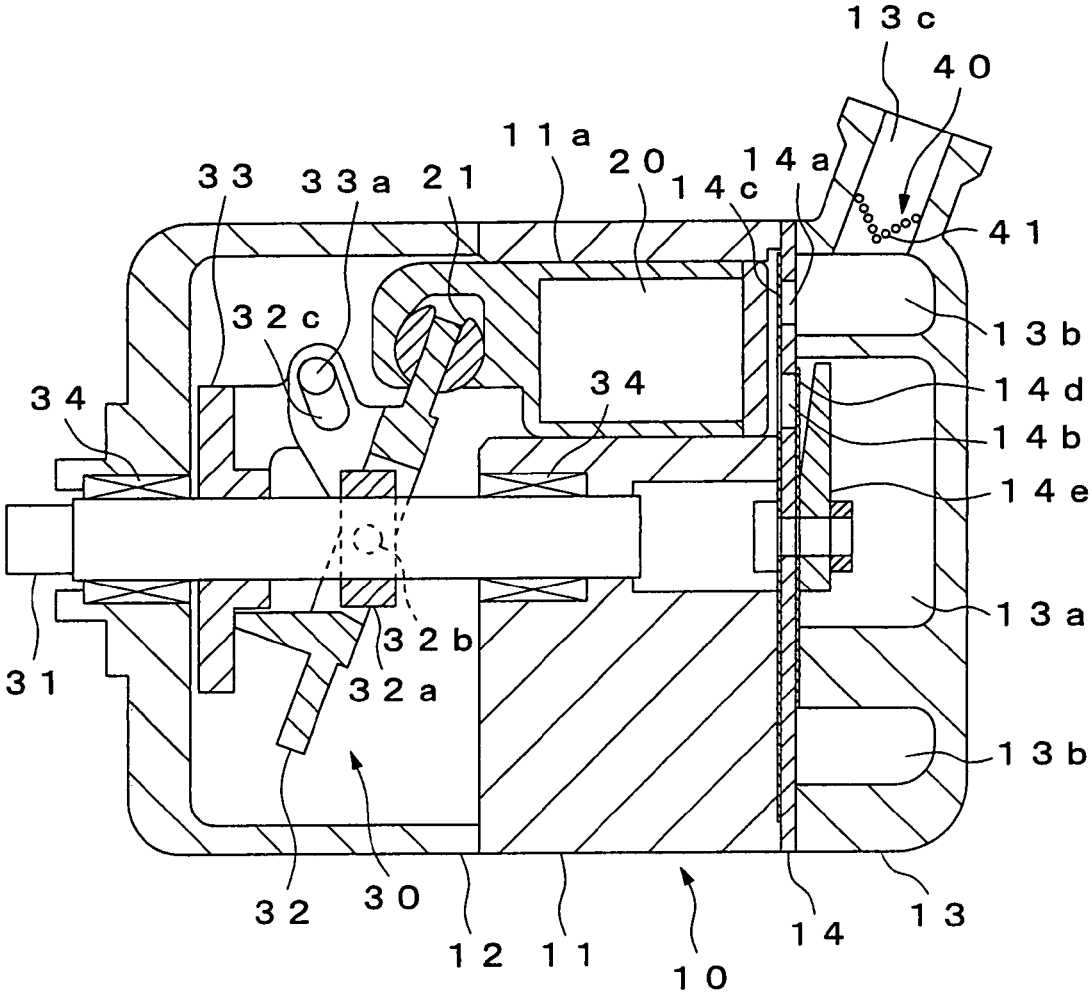
FIG. 1 is a side sectional view of a compressor representing a first embodiment of the invention.

FIGS. 1 to 3 show a first embodiment of the invention.

This compressor includes a compressor body 10 that sucks and discharges a refrigerant, a piston 20 that is provided inside the compressor body 10, a drive unit 30 that drives the piston 20, and an opening regulating valve 40 that regulates an opening according to a flow rate of the refrigerant. Power from the outside is inputted to the drive unit 30.

The compressor body 10 is formed in a cylindrical shape and includes a first housing 11 that is formed on the position of the piston 20 side, a second housing 12 that is formed on the position of the drive unit 30 side, a cylinder head 13 that is arranged on one end side of the first housing 11, and a valve plate 14 that is arranged between the first housing 11 and the cylinder head 13.

The first housing 11 has a cylinder 11*a* that extends in an axial direction of the compressor body 10 and one end of the cylinder 11*a* opens to one end face of the first housing 11. In addition, a stopper 11*b*, which locks an suction valve 14*c* to be described later in a predetermined opening position, is provided on one end side of the cylinder 11*a*, and the stopper 11*b* is formed by cutout of an edge of the cylinder 11*a*.

The second housing 12 opens on one end side, and the inside thereof communicates with the cylinder 11*a* of the first housing 11.

The cylinder head 13 is attached to one end of the first housing 11 via the valve plate 14, and a refrigerant discharge chamber 13*a* opening to the valve plate 14 side is provided in the center of the cylinder head 13. An annular refrigerant suction chamber 13*b* opening to the valve plate 14 side is provided around the refrigerant discharge chamber 13*a*, and the refrigerant suction chamber 13*b* communicates with a refrigerant suction channel 13*c* provided on a side of the cylinder head 13. In addition, the refrigerant discharge chamber 13*a* communicates with a refrigerant discharge channel (not shown) provided in the cylinder head 13.

Figure 2A:
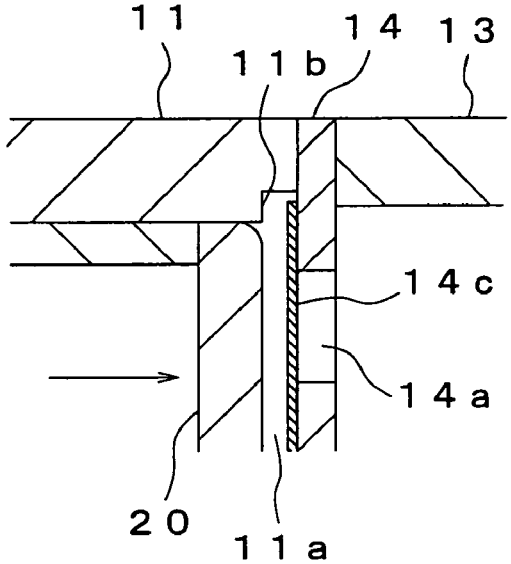
FIGS. 2A and 2B are main part side sectional views of the compressor.
Figure 2B:
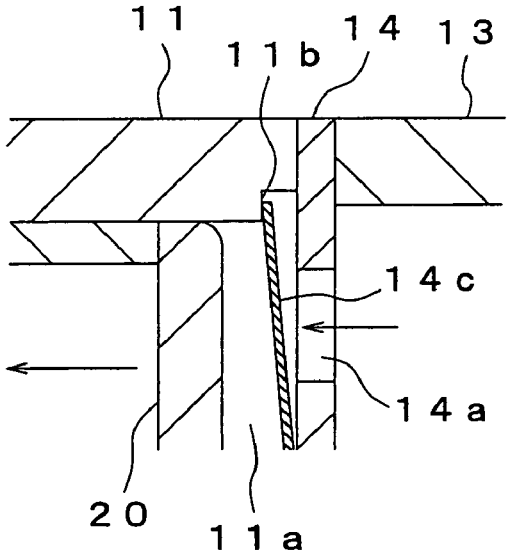

A refrigerant inlet 14*a* and a refrigerant outlet 14*b* communicating with the cylinder 11*a* are provided in the valve plate 14. The refrigerant inlet 14*a* communicates with the refrigerant suction chamber 13*b* of the cylinder head 13, and the refrigerant outlet 14*b* communicates with the refrigerant discharge chamber 13*a*. A tabular suction valve 14*c* and a tabular discharge valve 14*d*, which opens and closes the refrigerant inlet 14*a* and the refrigerant outlet 14*b*, respectively, are attached to the valve plate 14 such that the refrigerant inlet 14*a* and the refrigerant outlet 14*b* are opened and closed by elastic deformation of the suction valve 14*c* and the discharge valve 14*d*. One end side of the suction valve 14*c* is locked by the stopper 11*b*. As shown in FIG. 2A, in a discharge process of the piston 20, the one end side of the suction valve 14*c* comes into pressed contact with the valve plate 14 side to close the refrigerant inlet 14*a*. As shown in FIG. 2B, in an suction process of the piston 20, the one end side of the suction valve 14*c* bends to the cylinder 11*a* side to open the refrigerant outlet 14*b*. In this case, the suction valve 14*c* has a maximum opening in a position where one end side (free end side) of the suction valve 14*c* is locked by the stopper 11*b*. In addition, a stopper plate 14*e*, which locks the discharge valve 14*d*, is provided in the center of the valve plate 14. The discharge valve 14*d* is openable to a position where the discharge valve 14*d* is locked by the stopper plate 14*e*.

The piston 20 is housed in the cylinder 11*a* so as to slide freely so as to suck and discharge a refrigerant to one end face side thereof. In addition, a semispherical shoe 21, which is coupled with the drive unit 30 side, is attached to the other side of the piston 20 so as to slide freely.

The drive unit 30 includes a drive shaft 31 that is rotated by power from the outside, an inclining plate 32 that is rotated by the drive shaft 31, and an inclination regulating member 33 that regulates an inclination angle of the inclining plate 32 within a predetermined range. The drive shaft 31 is supported by the first housing 11 and the second housing 12 on one end side and the other end side so as to rotate freely via roller bearings 34, and for example, power of an engine of a vehicle is transmitted to the other end side via a not-shown pulley. The inclining plate 32 is supported by the drive shaft 31 via an annular slide member 32*a* so as to move freely in an axial direction and attached to the slide member 32*a* via a support shaft 32*b*. Thus, an inclination angle of the inclining plate 32 with respect to an axial direction of the drive shaft 31 changes arbitrarily around the support shaft 32*b*. In addition, a peripheral end of the inclining plate 32 is fitted in the shoe 21 of the piston 20 so as to slide freely such that the piston 20 reciprocates according to the inclination angle of the inclining plate 32 when the inclining plate 32 rotates. The inclination regulating member 33 is provided so as to rotate together with the drive shaft 31. A pin 33*a* provided at one end of the inclination regulating member 33 is inserted in a slit 32*c* provided in the inclining plate 32. Thus, when the inclining plate 32 slides, the pin 33*a* moves in the slit 32*c* such that an inclination angle of the inclining plate 32 is regulated within a predetermined range according to a moving range of the pin 33*a* in the slit 32*c*.

The opening regulating valve 40 is provided in the refrigerant suction channel 13*c* of the cylinder head 13 and includes an elastically deformable spiral member 41 fixed in the channel 13*c* at one end thereof. The spiral member 41 is formed such that diameters of spiral portions 41*a* gradually decrease from one end side to the other end side. Thus, when a flow rate of a refrigerant increases, intervals among the spiral portions 41*a* are widened by a flow resistance of the refrigerant.

In the compressor constituted as described above, when the drive shaft 31 of the drive unit 30 is rotated by drive power from the outside, the inclining plate 32 rotates and the piston 20 reciprocates in the cylinder 11*a* according to an inclination angle of the inclining plate 32. In addition, a refrigerant in the refrigerant suction chamber 13*b* is sucked into the cylinder 11*a* and discharged to the refrigerant discharge chamber 13*a* according to the reciprocation of the piston 20. In that case, the inclination angle of the inclining plate 32 is changed according to a pressure applied to the other end side (housing 12 side) of the piston 20 due to a pressure difference, which is caused between the refrigerant suction chamber 13*b* and the second housing 12 by not-shown pressure control means, whereby a discharge amount of the piston 20 is controlled.

Figure 3A:
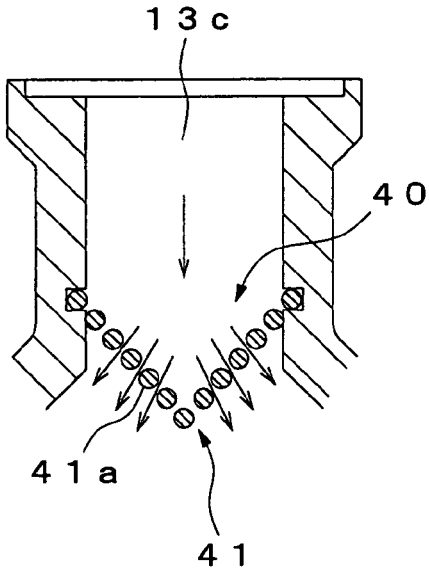
FIGS. 3A and 3B are side sectional views of an opening regulating valve.
Figure 3B:
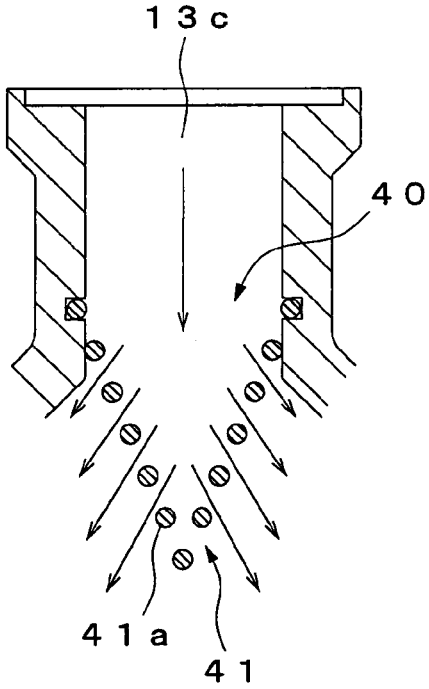

When a flow rate is high, as shown in FIG. 2B, the suction valve 14*c* opens to a position where the suction valve 14*c* is locked by the stopper 11*b* and, as shown in FIG. 3B, the intervals among the spiral portions 41*a* of the opening regulating valve 40 are widened and an opening of the refrigerant suction channel 13*c* increases. In addition, when a flow rate is low, as shown in FIG. 3A, since the intervals among the spiral portions 41*a* of the opening regulating valve 40 are narrowed and the opening of the refrigerant suction channel 13*c* decreases. Thus, even in the case in which pulsation occurs in an suction refrigerant due to self-induced vibration of the suction valve 14*c* at the time of a low flow rate, the pulsation of the suction refrigerant propagating to the external circuit on the refrigerant suction channel 13*c* side is attenuated by the opening regulating valve 40, and vibration and noise of an evaporator (not shown) and the like arranged in the external circuit are reduced.

In this way, according to the compressor of this embodiment, the opening regulating valve 40, which is provided in the refrigerant suction channel 13*c* to the cylinder 11*a*, is formed by the elastically deformable spiral member 41, and the intervals among the spiral portions 41*a* of the spiral member 41 are changed according to a flow rate of a refrigerant, whereby an opening of the channel 13*c* is regulated. Thus, it is possible to reduce occurrence of vibration and noise due to self-induced vibration of the suction valve 14*c* at the time of a low flow rate surely, simplify the structure of the opening regulating valve 40, and realize reduction in manufacturing cost.

In this case, the spiral member 41 of the opening regulating valve 40 is formed such that the diameters of the spiral portions 41*a* gradually decrease from one end side to the other end side. Thus, the spiral member 41 assumes a conical shape that is susceptible a flow resistance of a refrigerant, and it is possible to perform opening and closing of the channel 13*c* surely.

Note that, in this embodiment, the opening regulating valve 40 is provided in the refrigerant suction channel 13*c* communicating with the refrigerant suction chamber 13*b*. However, it is possible to obtain the same effect even in the case in which the opening regulating valve 40 is provided in a refrigerant discharge side channel communicating with the refrigerant discharge chamber 13*a*.

Figure 4A:
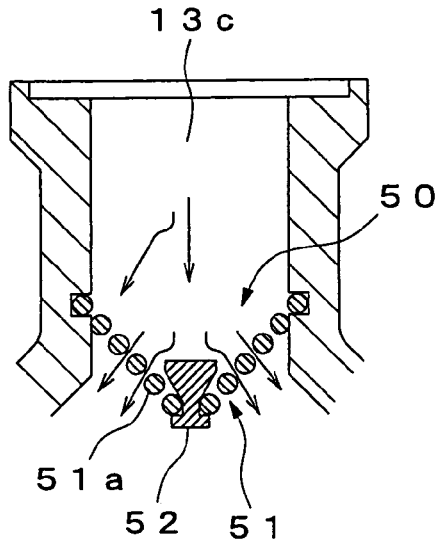
FIGS. 4A and 4B are side sectional views of an opening regulating valve representing a second embodiment of the invention.
Figure 4B:
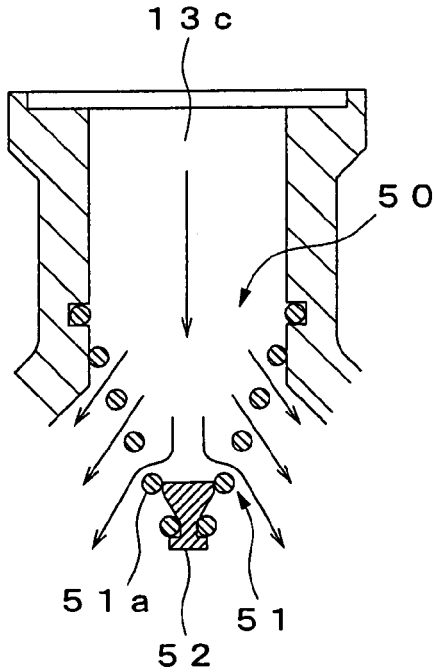

FIGS. 4A and 4B show a second embodiment of the invention, and components equivalent to those in the above-described embodiment are denoted by the identical reference numerals and signs.

In short, an opening regulating valve 50 shown in the figures has a spiral member 51, which is the same as that in the above-described embodiment, and is formed such that diameters of spiral portions 51*a* thereof gradually decrease from one end side toward the other end side. In addition, a blocking member 52, which blocks a part of the other end side of the spiral member 51, is attached to the other end side of the opening regulating valve 50. This blocking member 52 is formed in, for example, a size for blocking intervals among the spiral portions 51*a* by about one round trip and is held by the topmost spiral portion 51*a*.

In the opening regulating valve 50 of this embodiment, as in the first embodiment, intervals among the spiral portions 51*a* of the spiral member 51 change according to a flow rate of a refrigerant, an opening of the channel 13*c* is regulated, and the refrigerant does not pass a part where the blocking member 52 is attached. Thus, a flow rate of the refrigerant is regulated so much more for that. Hereby, since a flow rate in the refrigerant suction channel 13*c* can be made appropriate by the blocking member 52, it is possible to realize improvement of compression efficiency. In this case, it is possible to regulate an suction amount of the refrigerant arbitrarily by forming the blocking member 52 in an arbitrary size.

Figure 5A:
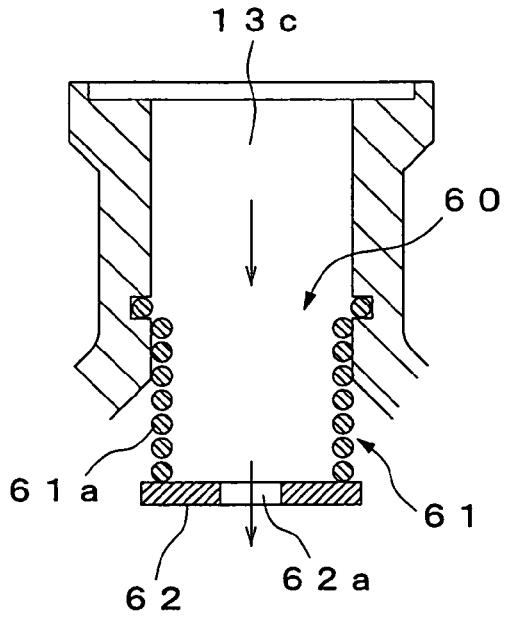
FIGS. 5A and 5B are side sectional views of an opening regulating valve representing a third embodiment of the invention.
Figure 5B:
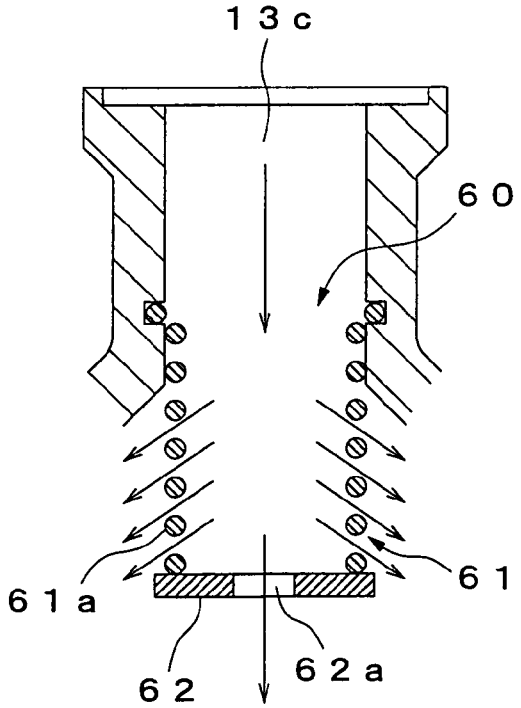

FIGS. 5A and 5B show a third embodiment of the invention, and components equivalent to those in the above-described embodiments are denoted by the identical reference numerals and signs.

In short, an opening regulating valve 60 shown in the figures has an elastically deformable spiral member 61, and diameters of spiral portions 61*a* thereof are formed uniformly from one end side to the other end side. In addition, a blocking member 62, which blocks the other end side of the spiral member 61, is attached to the opening regulating valve 60. This blocking member 62 consists of a tabular member, and a hole 62*a* allowing a refrigerant to flow is provided in the center of the blocking member 62.

In the opening regulating valve 60 of this embodiment, as in the first embodiment, intervals among the spiral portions 61*a* of the spiral member 61 change according to a flow rate of a refrigerant, an opening of the channel 13*c* is regulated, and the refrigerant does not pass a part where the blocking member 62 is attached. Thus, a flow rate of the refrigerant is regulated so much more for that. In other words, as in the second embodiment, since a flow rate in the refrigerant suction channel 13*c* can be made appropriate by the blocking member 62, it is possible to realize improvement of compression efficiency. In this case, it is possible to regulate an suction amount of the refrigerant by forming a hole 62*a* of the blocking member 62 in an arbitrary size.

INDUSTRIAL APPLICABILITY

As explained above, according to the invention, it is possible to reduce occurrence of vibration and noise due to self-induced vibration of an suction valve at the time of a low flow rate surely, and it is possible to simplify a structure of an opening regulating valve. Thus, it is possible to realize a reduction in manufacturing cost.

In addition, according to the invention, since a spiral member of an opening regulating valve assumes a conical shape that is susceptible to a flow resistance f a refrigerant, it is possible to perform opening and closing of a refrigerant suction side channel surely.

Further, according to the invention, since it is possible to regulate a flow rate of a refrigerant in an opening regulating valve such that a flow rate in a refrigerant suction side channel is made appropriate, it is possible to improve compression efficiency.

The invention claimed is:

1. A compressor that includes a cylinder, the cylinder comprising:

a refrigerant inlet and a refrigerant outlet at one end, a cylinder head comprising a refrigerant suction chamber in fluid communication with a refrigerant inlet and a refrigerant discharge chamber in fluid communication with a refrigerant outlet, a piston reciprocating in the cylinder, an suction valve provided in the refrigerant inlet, a discharge valve provided in the refrigerant outlet; and an opening regulating valve positioned in a refrigerant channel and selectively in fluid communication with one of the refrigerant suction chamber or the refrigerant discharge chamber, the opening regulating valve comprising:

an elastically deformable spiral member; and a blocking member configured to block an end side of the spiral member, wherein diameters of the spiral member are formed uniformly from the end side to an opposite end side, and wherein the blocking member comprises a tubular member and an opening formed therethrough in the center of the blocking member, configured to allow a refrigerant to flow, and is configured to regulate an opening of the channel by changing intervals among spiral portions of the spiral member according to a flow rate of the refrigerant.

* * * * *